United States Patent [19]

Smith

[11] Patent Number: 5,054,705

[45] Date of Patent: Oct. 8, 1991

[54] RECIPROCATING STRAND GUIDE FOR SPLIT STRAND ROVING PACKAGES

[75] Inventor: Roy E. Smith, Columbus, Ohio

[73] Assignee: Owens-Corning Fiberglas Corporation, Toledo, Ohio

[21] Appl. No.: 519,181

[22] Filed: May 4, 1990

[51] Int. Cl.[5] ..... B65H 54/02; B65H 54/20; B65H 67/048

[52] U.S. Cl. ..... 242/42; 242/18 A; 242/18 G.35.5 R

[58] Field of Search ..... 242/18 G, 18 A, 35.5 R, 242/42

[56] References Cited

U.S. PATENT DOCUMENTS

| | | | |
|---|---|---|---|
| 3,371,877 | 3/1968 | Klink et al. | 242/18 G |
| 3,414,956 | 12/1968 | Genson | 242/18 G X |
| 3,901,455 | 8/1975 | Carlisle | 242/18 G |
| 4,421,282 | 12/1983 | McKinney | 242/18 G |
| 4,488,686 | 12/1984 | Reese | 242/18 G |
| 4,538,773 | 9/1985 | McEathron | 242/18 G |
| 4,693,429 | 9/1987 | Billard et al. | 242/18 G |

*Primary Examiner*—Stanley N. Gilreath

*Attorney, Agent, or Firm*—Patrick P. Pacella; Ted C. Gillespie; David D. Murray

[57] ABSTRACT

A package winder for a plurality of multiple-filament strands or bundles includes a fixed strand shoe for forming strands, a movable strand shoe for separating the strands into an array of distinctly spaced and oriented bundles and a strand array guide which reciprocates along an axis parallel to the axis of a rotating collet. The guide includes an obliquiely oriented slot which maintains the arrangement of the strands of filaments as they are wound onto the collet. A pair of obliquely oriented parallel guide pins are disposed proximate the transverse limits of the reciprocating guide. The pins engage one or more of the strands, limiting the axial width of the package and greatly improving the edges of the package. The movable strand shoe, strand array guide and pins may be utilized in pairs to produce a pair of packages on a single elongated collet.

19 Claims, 6 Drawing Sheets

RECIPROCATING STRAND GUIDE FOR SPLIT STRAND ROVING PACKAGES

BACKGROUND OF THE INVENTION

The invention relates generally to an apparatus for winding a plurality of multi-filament strands or bundles into packages which maintains individual strand spacing and identity and more specifically to an apparatus for producing packages of a plurality of multi-filament strands having high strand integrity and distribution uniformity which results in stable package edges and facilitates snag and loop free removal of the strands from the package during subsequent operations.

Continuous filament materials such as glass fibers are commonly utilized in numerous and diverse products as a fibrous reinforcing material. Such material generally consist of a plurality of fiber bundles or strands which are in turn composed of a plurality of individual filaments. Such individual filaments are formed by a multi-orifice bushing, attenuated, sized, gathered into strands or bundles and then directly wound on a rotating collet into a hollow cylindrical package. Subsequently, one, and generally a plurality, of the packages provide pluralities of strands or bundles of filaments which are then formed into roving or utilized in other fabrication processes.

Many manufacturing and use constraints have been placed upon the packages so prepared. First of all, because the package must undergo certain and often extended handling, it is desirable that the corners and ends of the package be uniform and tightly wound in order to minimize the probability of damage to the package. Damage to the package manifests itself in broken filaments and strands. When the package is being unwound, filament and strand breaks significantly interfere with manufacturing processes and can significantly lower production throughput.

A second, related and more significant difficulty relates to the uniform withdrawal of strands or bundles from the package. Since typical fiber production may produce between ten and twenty strands or bundles of filaments which are aligned to form a sheet or array which is wound into the package, it is necessary that the material be removed in the same configuration. However, due to winding inaccuracies, the individual strands may unwind from the package in unequal lengths, generating loops, slack and other undesirable features in the array of strands. If the length differences become great enough, snarling of the strands can occur and strand removal from a package may necessarily be stopped to even out the strands and then restarted.

The apparatus for preparing such packages has been the object of much attention and development. Current technology in this field is relatively sophisticated. For example, U.S. Pat. No. 3,365,145 discloses an apparatus having a traversing guide and projecting pins which engage the band of strands winding onto the collet, ensuring that the band maintains uniform end positions resulting in a relatively straight edged package. A similar device utilizing guide pins is disclosed in U.S. Pat. No. 3,371,877. The apparatus disclosed therein includes a comb-like traversing guide. Each slot of the comb receives a single strand or bundle of filaments. Pins at each end of the guide comb engage the bundles and are intended to provide a straight edged package.

In U.S. Pat. No. 4,322,041, a traversing guide member is disposed proximate the package. The guide receives the strands in a V-shaped slot, the strands contact and are guided by one of the two sides of the slot depending upon which way the guide is traversing. The strand guide is maintained at a constant spacing from the outer surface of the wound package by means which contact the collet and the package forming thereupon.

U.S. Pat. No. 4,538,773 teaches another apparatus for collecting strands of filaments in which an oscillating guide includes a V-shaped slot and the oscillating guide traverses between a pair of pins. The pins are oriented generally parallel to the more adjacent sidewall of the V-shaped slot. Improved uniformity of package edges is also claimed for this apparatus.

From a review of the foregoing patent literature directed to package winding apparatus, it is apparent that improvements in this art are not only desirable but possible.

SUMMARY OF THE INVENTION

A package winder for a plurality of multiple-filament strands or bundles includes a fixed strand shoe for forming bundles, a movable strand shoe for separating the strands into an array of distinctly spaced and oriented strands and a strand array guide which reciprocates along an axis parallel to the axis of a rotating collet. The movable strand shoe is obliquely translatable between a first, upper position which facilitates start up of the winder and a second lower position which is the operating (winding) position. The guide includes an obliquely oriented slot which maintains the arrangement of the strands of filaments as they are wound onto the collet. A pair of obliquely oriented parallel guide pins are disposed proximate the transverse limits of the reciprocating guide. The pins engage one or more of the strands, rolling or curling the strands inwardly, limiting the axial width of the package and greatly improving the edges of the package. The movable strand shoe, strand array guide and pins are preferably utilized in pairs to produce a pair of packages on a single elongated collet.

Thus, it is an object of the present invention to provide an improved reciprocating strand guide and winder for producing highly uniform packages.

It is a further object of the present invention to provide an improved split strand winding apparatus having an obliquely translating split secondary shoe for facilitating start up and operation of the apparatus.

It is a still further object of the present invention to provide a package winding apparatus for simultaneously producing a pair of packages having straight edges on a common, elongated collet.

It is a still further object of the present invention to provide an improved reciprocating strand guide and winder that produces a package in which the multiple strands maintain their individual integrity and arrangement thereby greatly facilitating uniform delivery from the package.

DESCRIPTION OF THE PREFERRED EMBODIMENT

Figure 1:
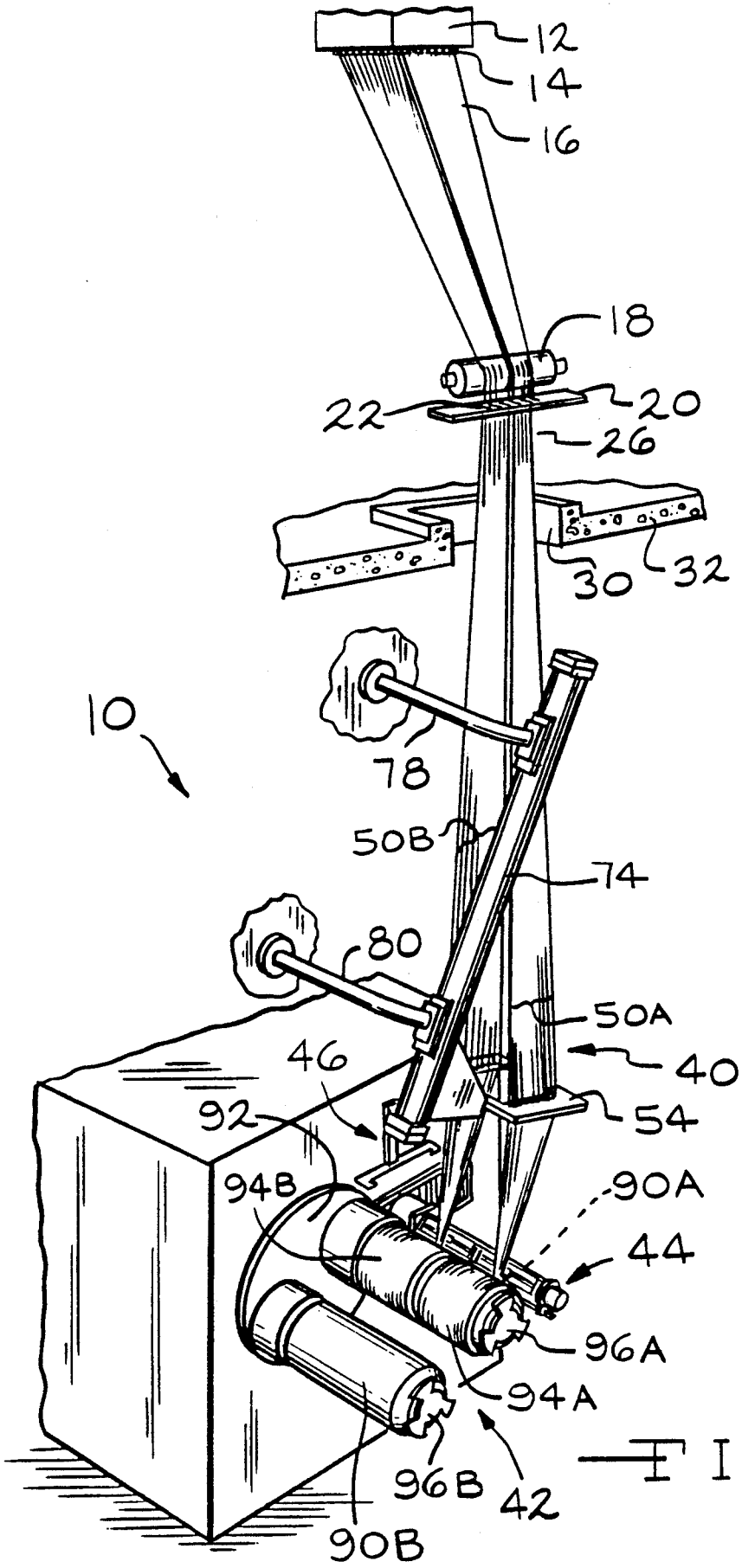
FIG. 1 is a diagrammatic perspective view of an apparatus for fabricating a plurality of multi-filament strands and winding them into a pair of packages according to the present invention.

Referring now to FIG. 1, an apparatus for winding split strand roving packages is illustrated and generally designated by the reference numeral 10. The split strand package winding apparatus 10 is used in conjunction with glass fiber forming equipment including a bushing 12 having a large plurality of bushing tips 14 disposed in parallel lines and columns and from which issue a plurality of filaments 16 of heat softened glass. Typically, the bushing 12 may include 1000 to 2000 or more bushing tips 14 which produce a like number of glass filaments 16. While in a softened state, the filaments 16 are drawn or attenuated by forces generated in the winding apparatus 10 as will be more fully described subsequently.

The filaments 16 are drawn away from the bushing 12 and pass in contact with the periphery of a size applying roller 18. The size applying roller 18 applies a coating of a suitable size to the filaments 16 in accordance with conventional practice. As will be readily understood and appreciated by those skilled in the art, a typical size may be a water or organic liquid based material containing, for example, lubricants, surfactants, emulsifiers, and other constituents intended to provide desirable characteristics to the glass filaments 16.

Next, the filaments 16 engage a primary shoe or comb 20 which defines a plurality of like configured, spaced apart slots 22. The primary shoe or comb 20 preferably defines an even number of slots 22 from few as two in number to twenty-four or more. The filaments 16 are received within the slots 22 in preferably equal numbers and a smaller plurality of strands or bundles 26 consisting of the filaments 16 are formed. Typically, each strand or bundle 26 may include about one hundred glass filaments 16 although this number may vary widely depending upon the design of the bushing 12, the number of slots 22 in the primary gathering shoe or comb 20 and the desired number of strands or bundles 26 to be formed. For purposes of description and example, it will be assumed that the primary gathering shoe or comb 20 includes twenty-four slots 22 such that twenty-four strands or bundles 26 are formed.

In a typical glass fiber forming operation, the just described components are disposed on the upper story or floor of a fabricating facility. The sized and separated strands or bundles 26 pass through a curbed aperture 30 in the floor 32 of the facility to associated apparatus on the floor below.

Turning now to the winding apparatus 10 itself which is disposed on a lower floor of a fiber fabricating facility, the winding apparatus 10 includes a secondary split shoe guide assembly 40, a twin collet, dual package winder assembly 42, a reciprocating twin guide assembly 44 and a strand knockoff assembly 46.

Figure 2:
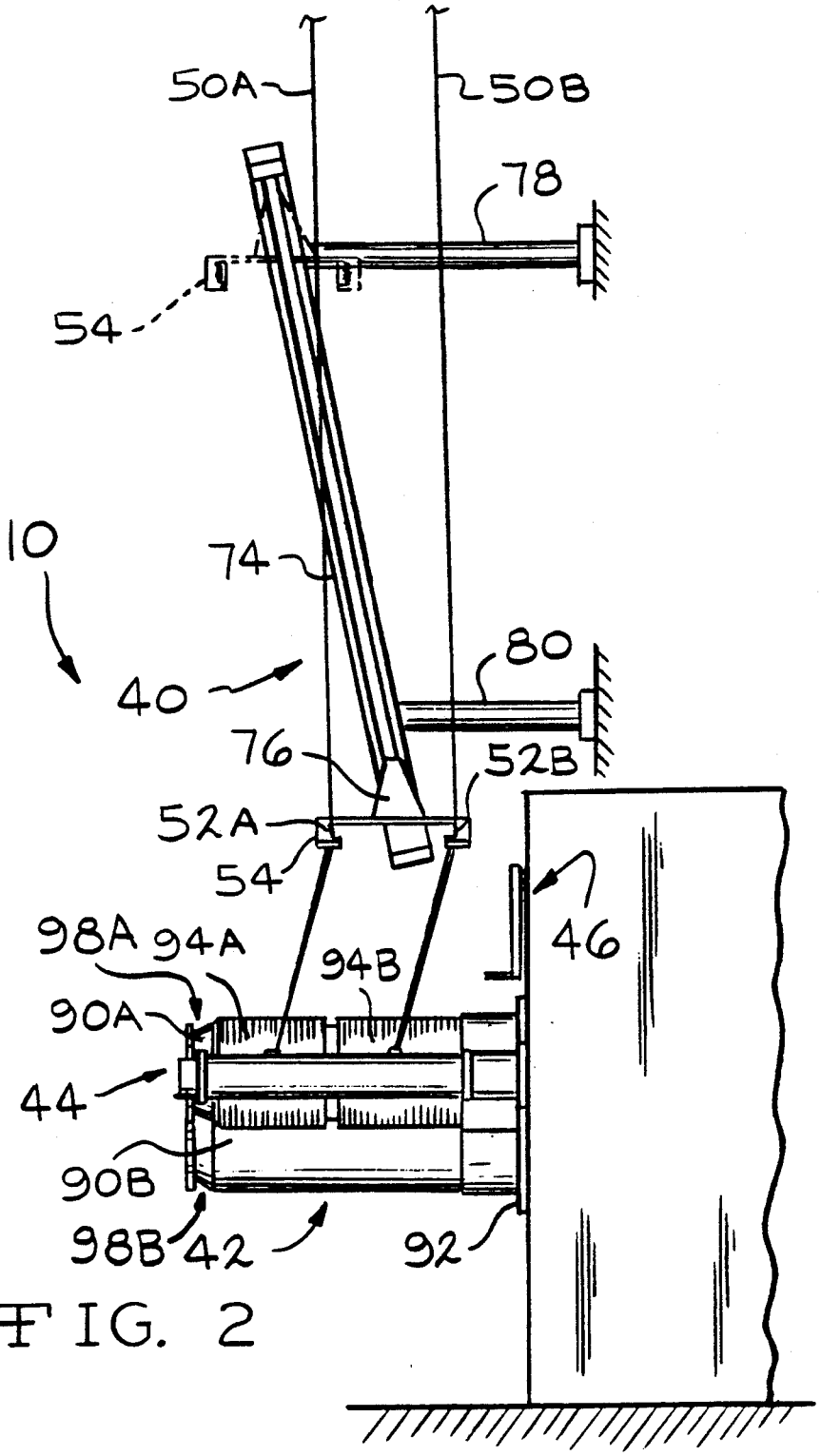
FIG. 2 is a side elevational view of an apparatus for winding a plurality of multi-filament strands or bundles into a pair of packages.
Figure 3:
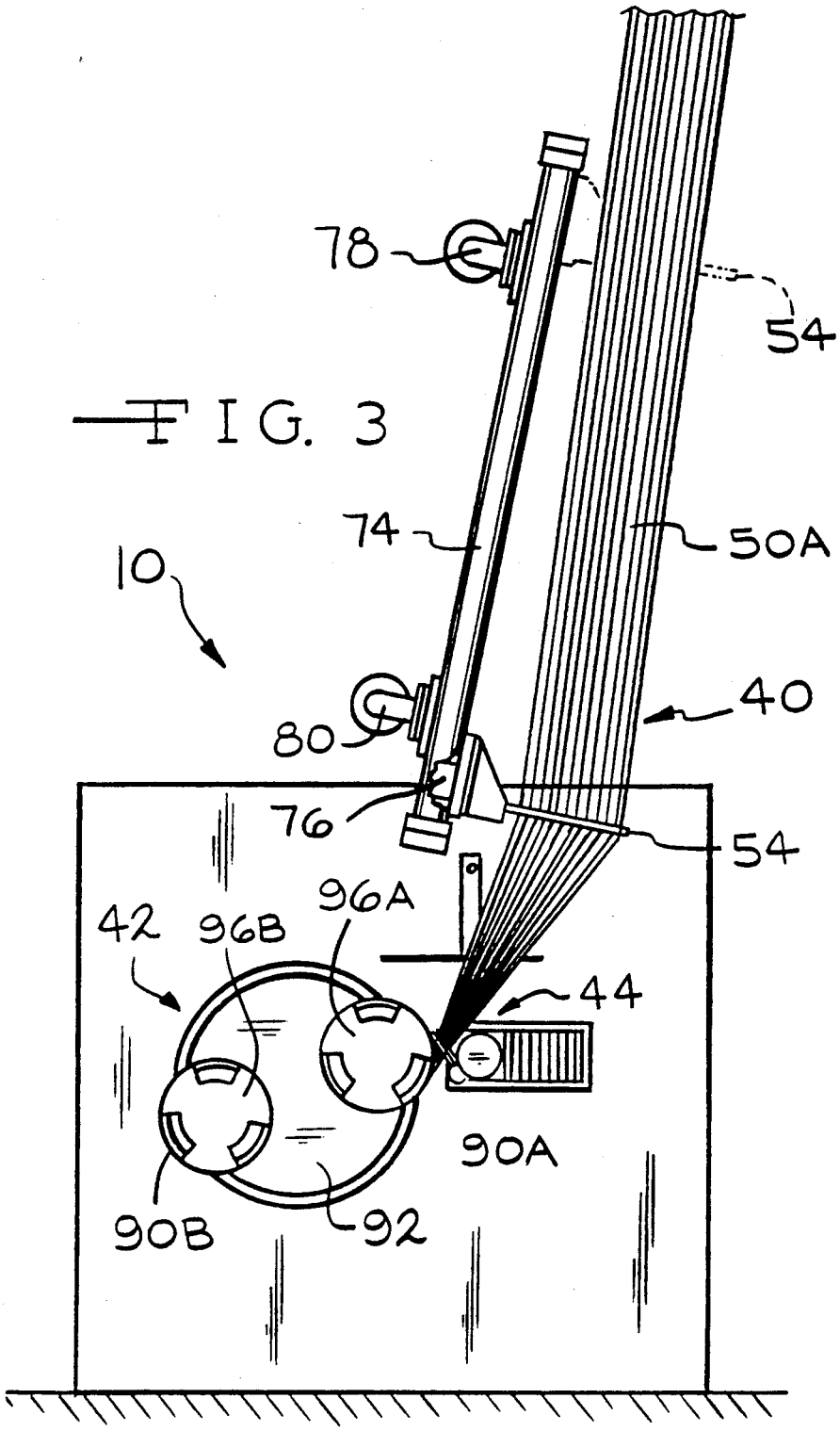
FIG. 3 is a front elevational view of an apparatus for winding a plurality of multi-filament strands or bundles into a pair of packages.
Figure 4:
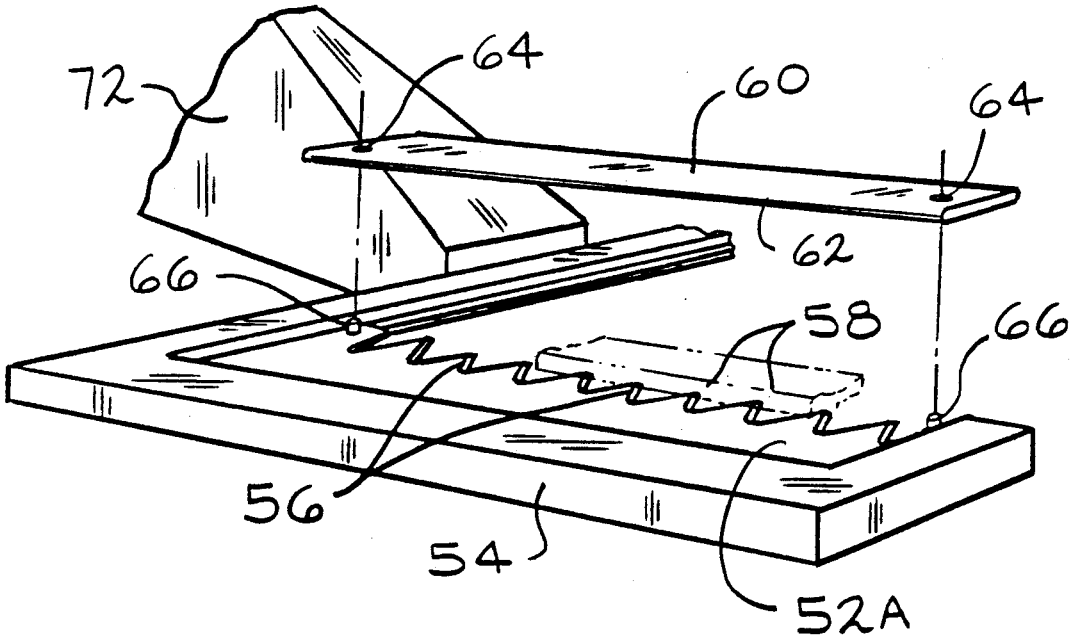
FIG. 4 is a perspective view of a portion of the split shoe guide assembly according to the present invention.

Referring now to FIGS. 2, 3 and 4, the secondary split shoe guide assembly 40 is illustrated. The secondary split shoe guide assembly 40 facilitates start up of the winding assembly 10 by maintaining the strands or bundles 26 in fixed, relative positions in two spaced apart, generally planar arrays 50A and 50B comprising the strands or bundles 26 in uniformly spaced, linear alignment. To maintain the strands or bundles 26 in the dual planar array, the split shoe guide assembly 40 includes a pair of opposed, split shoes 52A and 52B secured to opposite, parallel sides of a frame member 54.

In FIG. 4, one of the split shoes 52A, which is identical in all respects to the split shoe 52B but for its reverse, mirror-image mounting in the frame member 54, is illustrated. The split shoe 52A defines an array of uniformly spaced apart teeth 56 which define a plurality of strand or bundle receiving throats 58. Each of the split shoes 52A and 52B further includes an elongate retainer plate 60 which retains the strands or bundles 26 within the throats 58. The retainer plate 60 includes a rounded forward edge 62 and a pair of through apertures 64 which receive and register with a pair of pins 66 extending upwardly from the frame member 54 and through complementary openings in the split shoe 52A. The split shoe 52A and the retainer plate 60 are preferably fabricated of a durable plastic or plastic laminate such as Micarta or similar material. Each of the split shoes 52A and 52B thus provides an array 50A and 50B, respectively, of a plurality of linearly aligned, uniformly spaced apart strands or bundles 26 of the filaments 16.

The frame member 54 is coupled by a bracket 72 to an elongate piston 76 disposed within an obliquely oriented rodless air cylinder 74. The upper end of the rodless air cylinder 74 is secured to a support 78. An air hose or tubing (not illustrated) supplies compressed air to the upper end of the rodless air cylinder 74 and specifically the upper surface of the piston 76 to drive the piston 76 and the frame member 54 down. The lower end of the rodless air cylinder 74 is secured to a support 80. An air hose or tubing (not illustrated) supplies compressed air to the lower end of the rodless air cylinder 74 and specifically the lower surface of the piston 76 to drive the piston 76 and the frame member 54 up. Accordingly, when compressed air is provided to the lower end of the rodless air cylinder 74, the piston 76 and the frame member 54 ascends from the lower operating position illustrated in solid lines in FIGS. 2 and 3 to the upper, loading position illustrated in phantom lines. When compressed air is supplied to the upper end of the rodless air cylinder 74, the piston 76 and the frame member 54 descends. Alternatively, the frame member 54 may be translated by a lead screw oriented like the rodless air cylinder 74 and driven by a bi-directional motor (both not illustrated).

The rodless air cylinder 74 is oriented at approximately 11 degrees from the vertical as viewed in side elevation in FIG. 2 and at approximately 11 degrees from the vertical as viewed in front elevation in FIG. 3. Likewise, the frame member 54 is oriented at an angle of about 11 degrees below the horizontal as illustrated in FIG. 3. This angular orientation is considered to be the optimum for packages having a length of ten (10) inches. Consequently, if packages of lengths other than ten inches are wound, these orientations may be varied.

The split shoe guide assembly 40 facilitates start up of the winder assembly 10. When the frame member 54 and split shoes 52A and 52B are disposed in their uppermost position, the strands 26 may be most expeditiously positioned in the throats 58 of the split shoes 52A and 52B. When the frame member 54 is lowered, the split shoes 52A and 52B provide proper positioning, alignment and spacing of the arrays 50A and 50B of the bundles or strands 26 as they approach the twin collet, dual package winder assembly 42 and the reciprocating twin guide assembly 44. The split shoe guide assembly 40 also facilitates automatic transfer of the arrays 50A and 50B from one of the collets of the twin collet, dual package winder assembly 42 to the other when the packages on the one collet are complete.

The twin collet, dual package winder assembly 42 includes a pair of collets 90A and 90B each disposed for rotation about a horizontal axis. The collets 90A and 90B are mounted in spaced relation upon a turntable 92 also having a horizontal axis of rotation. The collets 90A and 90B are driven by conventional drive mechanisms (not illustrated) which are well-known in the art. Likewise, the turntable 92 is driven by an indexable drive mechanism (not illustrated) which rotates the turntable 92 and the collets 90A and 90B in 180 degree increments, thereby alternately positioning one or the other of the collets 90A and 90B into a package winding position or a package removing position.

In the drawing figures, the collet 90A is illustrated in the active, package winding position whereas the collet 90B is illustrated in the inactive or package removing position. It will be readily appreciated that the utilization of the twin collets 90A and 90B significantly improves production throughput of the winding assembly 10 inasmuch as at any given time one of the collets 90A or 90B may be rotating to wind a package whereas the other collet 90B or 90A will be inactive so that the machine operator may remove a previously wound package from the collet, preparing it for winding of the next package. It will also be appreciated that each of the collets 90A and 90B is of sufficient length to facilitate the production of two packages 94A and 94B at the same time. That is, the two arrays of strands 50A and 50B each form a separate package 94A and 94B, respectively, on the collet 90A.

Each of the collets 90A and 90B includes a spoked end cap 96A and 96B, respectively, disposed at its terminus. The spoked end caps 96A and 96B have a diameter slightly smaller than the diameters of the collets 90A and 90B to facilitate removal of the packages 94A and 94B therefrom. The ends of the collets 90A and 90B are frusto-conical and, with the spokes of the end caps 96A and 96B, respectively, form nips 98A and 98B which engage and grip the arrays 50A and 50B.

Figure 7:
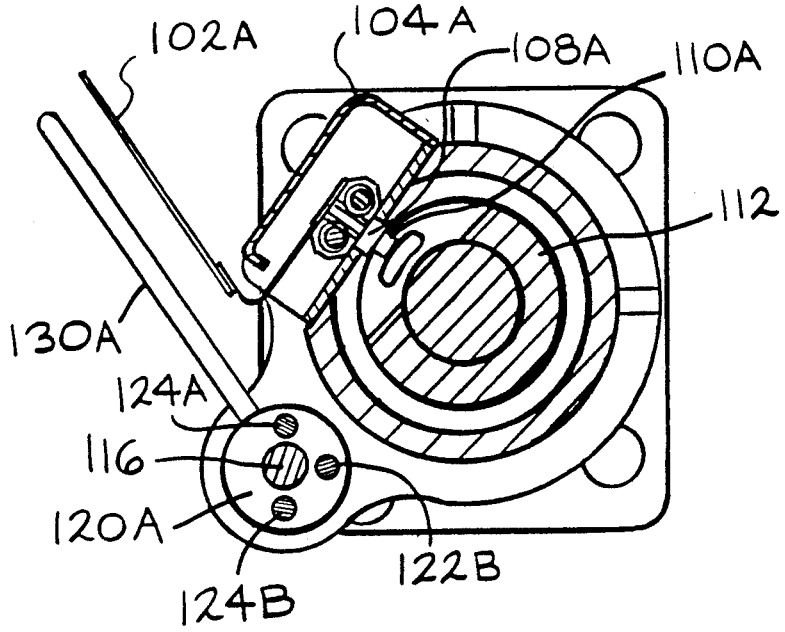
FIG. 7 is a full sectional view of the drive mechanism for reciprocating the strand array guides of a package winding apparatus according to the present invention taken along the line 7—7 of FIG. 6.
Figure 6:
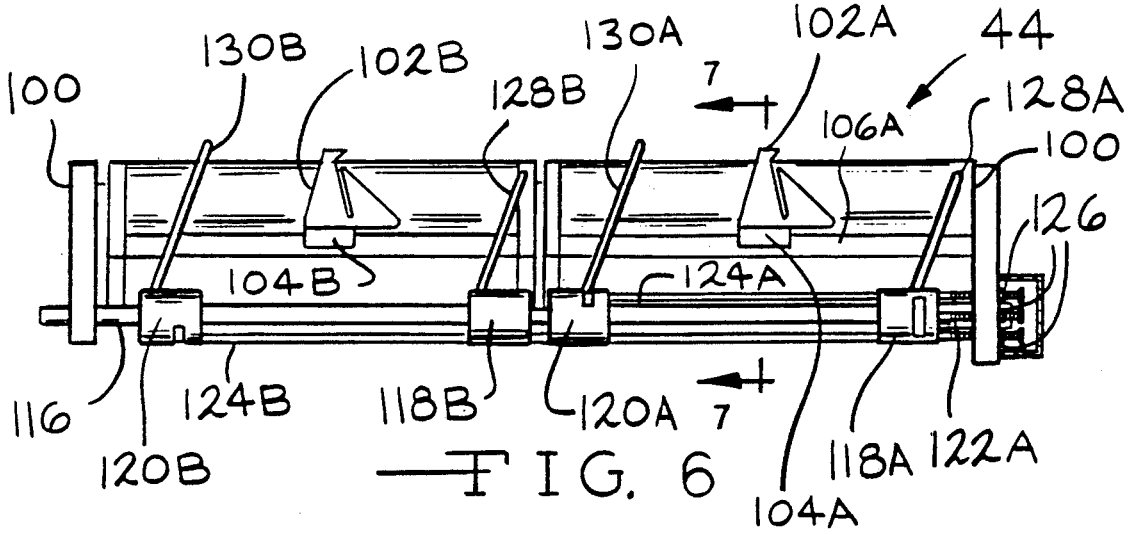
FIG. 6 is a side elevational view of the reciprocating strand array guides and tuck pins of a package winding apparatus according to the present invention.

Referring now to FIGS. 1, 6 and 7, the reciprocating twin guide assembly 44 is positioned adjacent the active, that is, the winding collet 90A, of the twin collet, dual package winder assembly 42. The reciprocating twin guide assembly 44 includes a frame 100 which extends generally along an axis parallel to and spaced from the axes of the collets 90A and 90B. The frame 100 receives a pair of spaced apart strand array guides 102A and 102B which reciprocate along an axis parallel to the winding collet 90A. The strand array guides 102A and 102B are axially spaced apart a distance equal to their reciprocating travel. The strand array guides 102A and 102B and associated drive assemblies are identical but for their relative axial positions along the frame 100. Accordingly, only the strand array guide 102A will be described in detail, it being appreciated and understood that such description applies equally and fully to the strand array guide 102B.

As illustrated in FIGS. 6 and 7, the strand array guide 102A is disposed at an angle of approximately 35 degrees from the vertical and is supported on a reciprocating shuttle or carriage 104A. The carriage 104A is slidably received upon suitable tracks 106A which facilitate rapid and free reciprocation along the horizontal axis of the frame 100. The carriage 104A also includes a follower 108A which is received within a complementarily configured endless helical track 110A formed in a rotating drive member 112. As will be readily appreciated, rotation of the drive member 112 reciprocates the carriage 104A and thus the strand array guide 102A from one end of the helical track 110A to the other and back again in conventional fashion.

The frame 100 and other components of the reciprocating twin guide assembly 44 are disposed for relatively slow radial motion toward and away from the active collet 90A in order to maintain appropriate relative positions between the guide assembly 44 and the outer surfaces of the packages 94A and 94B on the active collet 90A as their diameters increase during the winding operation. Such distance maintaining apparatus is conventional in the package winding art and may be controlled by signals derived from detecting the package size by a light or laser beam, a timing or sensing mechanism coupled to the rotation of the active collet 90A or mechanical or air pressure proximity sensing means. Alternatively, the distance may be maintained by an open loop control system which moves the frame 100 and the associated components in accordance with a mathematical or empirical time versus distance relationship. Preferably, the assembly 44 also includes a relatively fast drive unit (not illustrated) for rapidly translating the frame 100 and the associated components during the start up and transfer cycles described below.

The frame 100 also receives and secures a horizontally extending support rod 116. The support rod 116 is disposed along an axis parallel to the axis of the active collet 90A and the axis of reciprocation of the strand array guides 102A and 102B. Axially adjustably disposed on the support rod 116 are a first pair of non-rotating collars 118A and 120A associated with the strand array guide 102A and a second pair of non-rotating collars 118B and 120B associated with the strand array guide 102B. A first threaded adjustment rod 122A is coupled to the collar 118A by a suitable retaining device such that the adjustment rod 122A is free to rotate relative to the collar 118A and they translate axially in unison on the support rod 116. A second threaded adjustment rod 124A is coupled to the collar 120A by a suitable retaining device such that the adjustment rod 124A is free to rotate relative to the collar 120A and they translate axially in unison on the support rod 116. A third threaded adjustment rod 122B is coupled to the collar 118B by a suitable retaining device such that the adjustment rod 122B is free to rotate relative to the collar 118B and they translate axially in unison on the support rod 116. A fourth threaded adjustment rod 124B is coupled to the collar 120B by a suitable retaining device such that the adjustment rod 122B is free to rotate relative to the collar 120B and they translate axially in unison on the support rod 116.

Each of the threaded adjustment rods 122A, 124A, 122B and 124B passes through a complementarily threaded opening (not illustrated) in the frame 100 and further includes a jam nut 126 disposed thereon adjacent the frame 100. By appropriate loosening of the jam nuts 126 and rotation of the adjustment rods 122A, 124A, 122B and 124B, the axial positions of the associated collars 118A, 120A, 118B and 120B, respectively, may be finely adjusted. The jam nuts 126 may then be tightened against the frame 100 to fix the positions of the collars 118A, 120A, 118B and 120B.

Extending obliquely from the non-rotating collar 118A is a right tuck or guide pin 128A and from the collar 120A is a longer, left tuck or guide pin 130A. Extending obliquely from the non-rotating collar 118B is a right tuck or guide pin 128B and from the collar 120B is a longer, left tuck or guide pin 130B. The tuck pins 128A, 128B, 130A and 130B are parallel and are inclined at an angle of approximately 20 degrees from the vertical as viewed from the side of the frame 100 in FIG. 6 and they are also inclined at an angle of approximately 35 degrees from the vertical when viewed along the axis of the frame member 100 as illustrated in FIG. 7. As is also apparent in FIG. 7, the axes of the tuck pins 128A, 128B, 130A and 130B are parallel to the plane defined by the strand array guides 102A and 102B.

Figure 5:
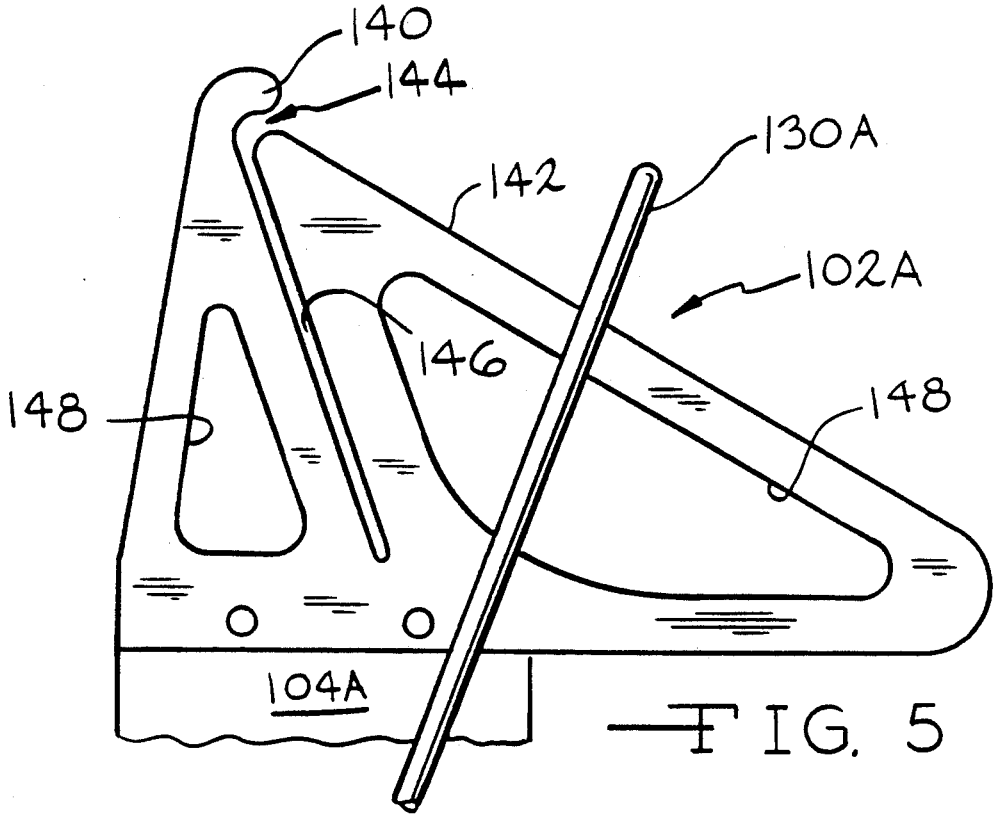
FIG. 5 is an enlarged side elevational view of the strand guide and right tuck pin according to the present invention.

Referring now to FIGS. 5 and 6, the strand array guide 102A which is one of a pair of identical strand array guides 102A and 102B, and the right tuck pin 130A is illustrated. The strand guide 102A generally defines an isosceles triangle preferably fabricated of a thin plastic or plastic laminate material such as Micarta. The strand guide 102A includes a curved nosepiece 140 directed toward the front of the apparatus 10, that is, to the right in FIG. 6. The nosepiece 140 and an obliquely oriented edge 142 define a throat 144 which communicates with an elongate slot 146 oriented at an angle of 70 degrees from the axis of reciprocation of the guide 102A and the axis of the support rods 120A and 120B, that is, 20 degrees from the vertical. Accordingly, the elongate slot 146 and the tuck pins 128A and 130A define angles of 40 degrees as seen in FIG. 6. The elongate slot 146 receives the strands or bundles 26 of the corresponding array 50A after it passes through the split shoe 52A and maintains the strands or bundles 26 in uniform, spaced orientation as illustrated in FIG. 3. Preferably, the strand guide 102A includes generally irregular cut-outs 148 which reduce the mass of the strand guide 102A and thus reduce both the energy required to reciprocate it and wear on associated equipment.

With reference now to FIGS. 4, 5 and 6, it will be appreciated that the strand guides 102A and 102B cooperate with the pairs of left and right tuck pins 128A, 128B, 130A and 130B to align and slightly roll or curl one or more strands or bundles 26 of the corresponding arrays 52A or 52B to assist the formation of straight (square) edges on the packages 94A and 94B. Specifically, as the strand guide 102A approaches the left tuck pin 130A, the strands 26 of the array 52A disposed in the upper most portion of the elongate slot 146 will engage the left tuck pin 130A and be displaced and positively guided. Similarly, as the strand guide 102A approaches the right most limit of travel and the right tuck pin 128A, the lower strands or bundles 26 passing through the elongate slot 146 engage the right tuck pin 128A. Such engagement displaces and rolls or curls one or more of the strands 26, displacing and positively guiding them. As noted above, the positions of the tuck pins 128A, 128B, 130A and 130B may be axially adjusted as described above to control the degree of engagement between the strands or bundles 26 of the arrays 52A and 52B and the respective tuck pins 128A, 128B, 130A and 130B.

Figure 8:
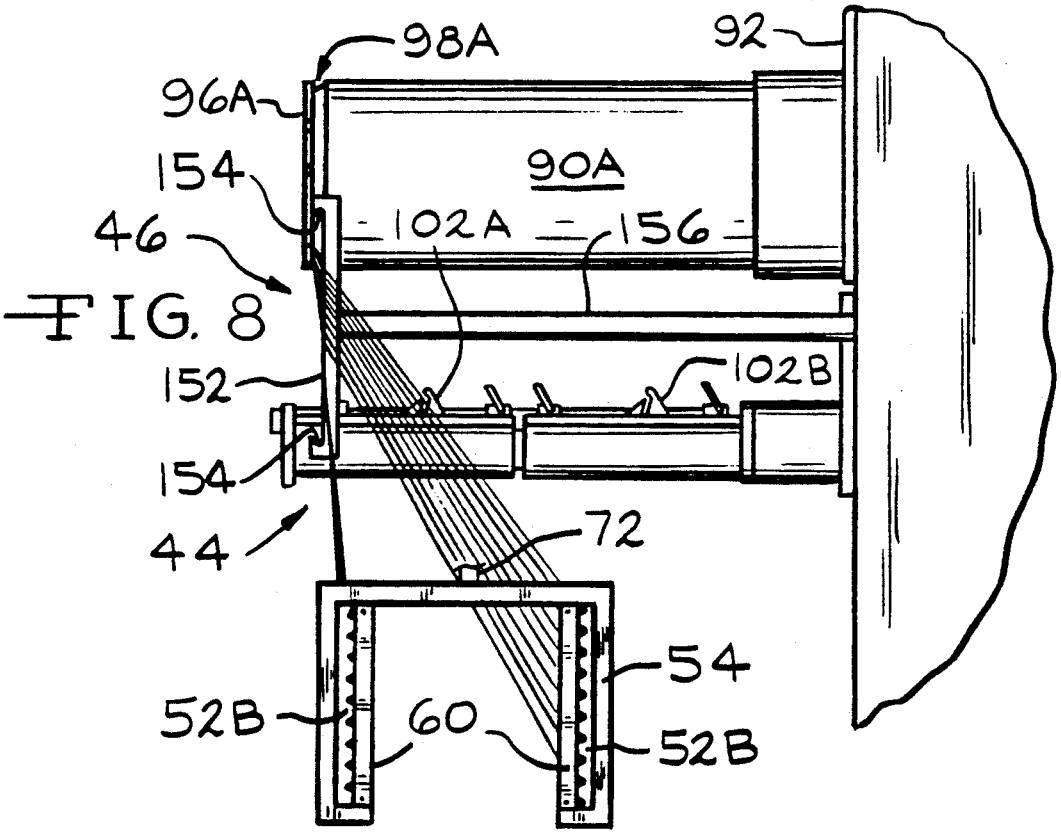
FIG. 8 is a top plan view of an apparatus for winding a plurality of multi-filament strands or bundles into a pair of packages at start up.

As best illustrated in FIGS. 1, 2 and 8, the winding apparatus 10 also includes a knockoff guide assembly 46. The knockoff guide assembly 46 functions during winder start up and collet changeover and includes an elongate horizontal guide 152 having opposed curved reentrant ends 154. The knockoff guide 152 is preferably fabricated of Micarta or similar material. The guide 152 is supported for translation along an axis parallel to and spaced from the axes of the collets 90A and 90B on a piston rod 156 of a double-acting cylinder (not illustrated). When the cylinder is pressurized in a first mode, the piston rod 156 and the knockoff guide 152 extend to the position illustrated in FIG. 8. When the cylinder is pressurized in its second mode, the piston rod 156 and the knockoff guide 152 retract to the position illustrated in FIGS. 1, 2 and 9.

The operation of the winding apparatus 10 will now be described with reference to all of the drawing figures, especially FIGS. 1, 6, 8 and 9. According to conventional and well-known technology, the bushing 12 provides a large number of filaments 16 which are sized by the size applying roller 18 and assembled into a plurality of uniform strands or bundles 26 by the primary shoe or comb 20.

Figure 9:
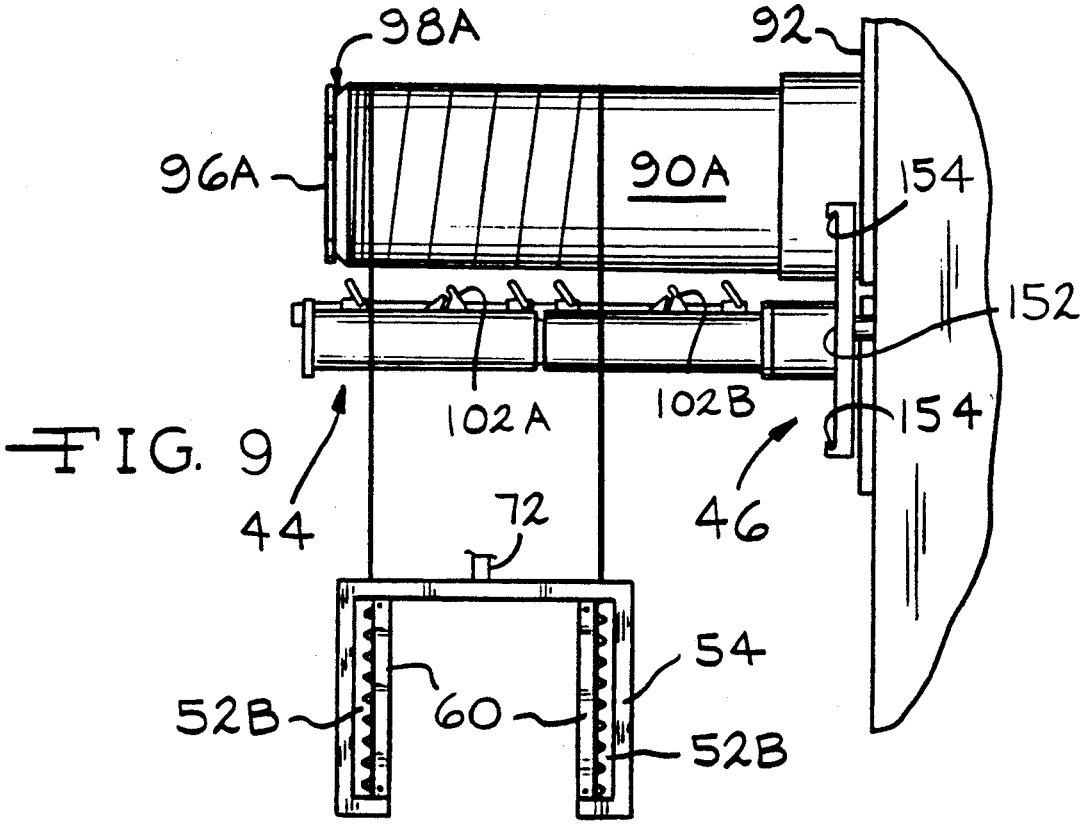
FIG. 9 is a top plan view of an apparatus for winding a plurality of multi-filament strands or bundles into a pair of packages after the winding operation has commenced but before the strands are threaded into the reciprocating shuttles.

At start up, the frame member 54 and the split shoes 52A and 52B are in the upper position illustrated in phantom lines in FIGS. 2 and 3, the reciprocating twin guide assembly 44 is most distant the active collet 90A and the knockoff guide assembly 46 is extended, all as illustrated in FIG. 8. After the strands 26 are disposed within the throats 58 of the split shoes 52A and 52B and the retainer plates 60 have been placed into position as illustrated in FIG. 4, the collet 90A may be activated and begins rotating. The arrays 50A and 50B are then manually guided over the knock- off guide 152, engaged by the spokes of the spoked end cap 96A and threaded into the nip 98A of the active collet 90A. When the collet 90A is rotating at operating speed, the knockoff guide 152 retracts whereupon the arrays 50A and 50B begin to collect on the active collet 90A as illustrated in FIG. 9.

At this time, the reciprocating twin guide assembly 44 advances toward the active collet 90A to its start up position. Finally, the frame member 54 and specifically the split shoes 52A and 52B descend to the lower position illustrated in solid lines in, for example, FIGS. 1, 2 and 3. As best illustrated in FIG. 3, because of the changed angular relationships of the arrays 50A and 50B with the reciprocating strand guides 102A and 102B effected by the translation of the split shoes 52A and 52B from the upper position to the lower position, the arrays 50A and 50B thread without manual intervention into the elongate slots 146 of the strand guides 102A and 102B.

At this time, threading and start up of the winder apparatus 10 is complete and winding of the packages 94A and 94B will continue until a desired diameter is achieved. During this time, the reciprocating twin guide assembly 44 will translate radially away from the active collet 90A as the diameter of the packages 94A and 94B increases, as noted above.

When the packages 94A and 94B are complete, the reciprocating twin guide assembly 44 translates to a position most distant the active collet 90A, the split shoes 52A and 52B translate to their upper position and the knockoff guide assembly 46 extends. Once again, the arrays 50A and 50B wind into the nip 98A of the active collet 90A. At this time, the turntable 92 rotates 180 degrees and the inactive collet 90B is exchanged for the active collet 90A and becomes the active collet. The start up cycle described above is then repeated. It will thus be apparent that the winding apparatus 10 of the present invention facilitates automatic and continuous package winding.

It should be noted that the rotational speed of the collet 90A is proportional to the speed of reciprocation of the strand guides 102A and 102B. Accordingly, as the collet 90A begins to rotate, the strand guides 102A and 102B begin to reciprocate. The speed at which these components operate determines the degree of attenuation of the filaments 16, as will be readily appreciated. At the limit of left and right reciprocation of the strand guides 102A and 102B, one or more of the strands or bundles 26 engages the tuck pins 128A, 128B, 130A and 130B. The extent of engagement between the array of strands 50A and 50B and the associated tuck pins 128A, 128B, 130A and 130B may be adjusted by axially displacing the tuck pins 128A, 128B, 130A and 130B.

The foregoing description has disclosed and described the winding apparatus 10 in conjunction with the fabrication of glass filaments and the production of glass filament packages. Nonetheless, the invention will find application in similar processes related to the manufacture of other filamentary material such as inorganic, plastic and various synthetic fibers. Accordingly, the foregoing disclosure should be appreciated as illustrative and explanatory of the present invention but should not be considered to be limited by the composition of the specific fibers produced and processed thereupon.

The foregoing disclosure is the best mode devised by the inventor for practicing this invention. It is apparent, however, that apparatus incorporating modifications and variations will be obvious to one skilled in the art of filament and fiber winding. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. An apparatus for winding packages from a plurality of multi-filament strands comprising, in combination, means for providing a plurality of multi-filament strands in a spaced, aligned array having a pair of marginal edges, a strand guide disposed for reciprocation along a first axis, said strand guide defining an elongate slot having parallel sidewalls, said elongate slot oriented at an angle to said first axis, a pair of parallel pin means disposed adjacent the limits of reciprocation of said strand guide for engaging a respective one of said pair of marginal edges, said pair of pin means disposed at an acute angle to said elongate slot of said strand guide at an acute angle to said first axis, and a rotating collet means adjacent said strand guide for receiving said spaced, aligned array of strands, whereby said spaced array of strands are received within said elongate slot and said pair of marginal edges alternately engage a respective one of said pair of pin means as said strand guide reciprocates.

2. The apparatus of claim 1 further including bushing means for producing a plurality of glass filaments.

3. The apparatus of claim 1 wherein said means for providing a plurality of strands includes a shoe movable between a first upper, loading position and a second, lower, operating position.

4. The apparatus of claim 1 further including a second rotating collet, said collets disposed for rotation along parallel, spaced apart axes and disposed upon a rotatable member having an axis of rotation parallel to said axes of rotation of said collets.

5. The apparatus of claim 1 further including a pair of mounting members for receiving a respective one of said pair of pin means and a pair of means for adjusting a respective one of said mounting members along an axis parallel to the axis of reciprocation of said strand guide.

6. The apparatus of claim 1 wherein said parallel sidewalls of said elongate slot are uninterrupted.

7. An apparatus for winding a plurality of multiple filament strands into a cylindrical package comprising, in combination, means for providing a plurality of multi-filament strands, a shoe guide for disposing said strands into at least one planar array having a plurality of linearly spaced apart strands, a strand guide disposed for reciprocation along an axis between first and second limits, said strand guide defining an elongate array receiving slot oriented at an acute angle to said axis and having parallel sidewalls, pin means for engaging at least one strand of said array adjacent each of said first and second limits of reciprocation of said strand guide, said pin means oriented parallel to one another and disposed at acute angles both to said slot and to said axis of reciprocation, a rotating collet for receiving and forming a package from said array of strands.

8. The apparatus of claim 7 wherein said shoe guide is movable between a first position more proximate said providing means and a second position more proximate said strand guide.

9. The apparatus of claim 7 wherein said shoe guide is split and disposes said strands into a second planar array having a plurality of linearly spaced apart strands and further includes a second said strand guide and a second said pin means.

10. The apparatus of claim 7 further including a pair of mounting members for receiving a respective one of said pair of pin means and a pair of means for adjusting a respective one of said mounting members along an axis parallel to the axis of reciprocation of said strand guide.

11. The apparatus of claim 7 wherein said pin means are disposed on a respective one of a pair of independent mounting members adjustable along an axis parallel to the axis of reciprocation of said strand guide.

12. The apparatus of claim 7 wherein the sidewalls of said elongate slot are uninterrupted.

13. An apparatus for forming multi-filament strand roving packages comprising, in combination, means for providing a plurality of multi-filament strands in a spaced, aligned array having a pair of marginal edges, shoe guide means for maintaining said multi-filament strands in said spaced array and movable between a first, upper loading position and a second, lower, operating position, a strand guide disposed for reciprocation along an axis between first and second limits, said strand guide defining an elongate slot having parallel sidewalls and oriented at an acute angle to said axis, a pair of spaced apart pin means for engaging at least one strand of said array when said strand guide is proximate each of said first and said second limits of reciprocation, said pair of pin means disposed in parallel and at an acute angle to said elongate slot and at an acute angle to said axis, a rotating collet disposed adjacent said strand guide for receiving said array of strands.

14. The apparatus of claim 13 wherein said collet rotates about an axis parallel to said axis of reciprocation of said strand guide.

15. The apparatus of claim 13 further including a second rotating collet, said collets disposed upon an indexable, rotatable member having an axis of rotation parallel to the axis of rotation of said collets.

16. The apparatus of claim 13 wherein said shoe guide means includes a pair of opposed strand spacing and retaining members for providing a pair of arrays and said apparatus further includes a second said reciprocating strand guide and second said pair of pin means.

17. The apparatus of claim 13 wherein said pins are parallel to said strand guide.

18. An apparatus for winding said split strand roving packages comprising, in combination, means for supplying a plurality of multi-filament strands, means for disposing said strands into a pair of spaced apart linear arrays each having a pair of marginal edges, a pair of strand guides disposed for reciprocation along an axis between first positions and second positions, said strand guides defining an elongate slot for receiving a respective one of said linear arrays of strands, said elongate slot having parallel sidewalls and oriented at an acute angle to said axis, a pair of pin means associated with each of said strand guides, said pair of pin means associated with each of said guides disposed in parallel and at an acute angle to said axis and at an acute angle to said slot, one of each of said pair of pin means disposed generally adjacent each of said first and second positions for engaging a respective one of said pair of marginal edges of said linear arrays, a rotatable collet means disposed for rotation about a second axis adjacent said first axis for receiving said pair of linear arrays and winding said arrays into a respective pair of packages.

19. The apparatus of claim 18 wherein said strand disposing means is movable between an upper position more proximate said supplying means and a lower position more proximate said strand guides.

* * * * *